US006766787B2

(12) United States Patent
Kihlberg et al.

(10) Patent No.: US 6,766,787 B2
(45) Date of Patent: Jul. 27, 2004

(54) MAGNETIC IGNITION SYSTEM

(75) Inventors: Johan Kihlberg, Bengtsfors (SE); Lars-Olof Ottosson, Tösse (SE)

(73) Assignee: Sem AB, Åmål (SE)

( * ) Notice: Subject to any disclaimer, the term of this patent is extended or adjusted under 35 U.S.C. 154(b) by 57 days.

(21) Appl. No.: 10/221,000

(22) PCT Filed: Mar. 7, 2001

(86) PCT No.: PCT/SE01/00482

§ 371 (c)(1),
(2), (4) Date: Nov. 22, 2002

(87) PCT Pub. No.: WO01/66937

PCT Pub. Date: Sep. 13, 2001

(65) Prior Publication Data

US 2003/0172909 A1 Sep. 18, 2003

(30) Foreign Application Priority Data

Mar. 8, 2000 (SE) ..... 0000767

(51) Int. Cl.[7] ..... F02P 1/08; F02P 3/08; F02P 5/145

(52) U.S. Cl. ..... 123/406.57; 123/149 D; 123/603

(58) Field of Search ..... 123/406.57, 601, 123/603, 599, 149 D

(56) References Cited

U.S. PATENT DOCUMENTS 4,566,425 A 1/1986 Nitou et al.
4,611,570 A 9/1986 Nash
4,643,150 A 2/1987 Miura et al.
5,020,506 A 6/1991 Ozawa
5,111,798 A * 5/1992 Notaras et al. ..... 123/637
5,161,489 A * 11/1992 Morooka ..... 123/41 E
5,392,753 A * 2/1995 Burson et al. ..... 123/406.57
5,606,958 A * 3/1997 Chrintz-Gath et al. ..... 123/601
6,020,742 A 2/2000 Kano et al.
6,405,687 B1 * 6/2002 Arakawa et al. ..... 123/41 E
6,474,273 B1 * 11/2002 Kinoshita et al. ..... 123/41 E

FOREIGN PATENT DOCUMENTS

DE 197 20 532 A1 1/1999
WO WO 97/08642 A1 3/1997

* cited by examiner

*Primary Examiner*—Mahmoud Gimie
*Assistant Examiner*—Arnold Castro
(74) *Attorney, Agent, or Firm*—Ware, Fressola, Van Der Sluys & Adolphson LLP

(57) ABSTRACT

A circuit to achieve a large ignition advance, limitation of speed of revolutions and to prevent backfiring and reverse direction running in a magnetic ignition system comprises a flywheel with two poles and a three-legged iron core. An ignition transformer (L3/L4), a triggering coil (L2) and a charging coil (L1) are arranged on the legs of the core. The triggering coil is arranged either on the first or second leg in the direction of rotation of the flywheel, and the charging coil on the final leg. A time-constant circuit (an RC net) and a control switch (T2) are arranged between the charging coil and a main switch (T1) that opens/blocks triggering pulses whereby limitation in the speed of revolutions is achieved by means of adjustment of the time-constant circuit.

5 Claims, 3 Drawing Sheets

MAGNETIC IGNITION SYSTEM

BACKGROUND OF THE INVENTION

1. Technical Field

The present invention concerns a circuit for achieving large ignition advance, limitation of the speed of revolutions in both directions of rotation, and for preventing backfiring in a magnetic ignition system comprising a flywheel and a three-legged iron core.

2. Description of the Related Art

For reasons of safety, the motor in a motor saw or similar device must not rotate in the wrong direction since this means that the saw chain also rotates in the wrong direction, leading to the risk of personal injury. If the fuel/air mixture in the motor is ignited significantly before the piston reaches its turning point when trying to start the motor, the motor can start to rotate backwards, since its kinetic energy is low during start, which means that the piston can be pressed downwards in the wrong direction of rotation. Such a process in a motor is known as "backfiring". In certain conditions, the motor can also reverse its direction of rotation during operation, which is known as "reverse direction running". The risk for personal injury must be eliminated if the motor starts in the wrong direction.

In order to prevent backfiring, it is desired to ignite the mixture close to the upper turning point the piston (top dead centre) when running at low speed, since the kinetic energy of the motor is then low, this is known as "low ignition advance". On the other hand, at high speed, it is desired to ignite the mixture earlier, since this extracts more power from the motor. This is known as using a "high ignition advance".

An ignition system with a large ignition advance (a large difference between the time of ignition at low speed and the time of ignition at high speed) thus makes it possible to reduce the risk of backfiring at low speed at the same time as making it possible to extract a great deal of power from the motor at high speed. However, this is difficult to achieve with one module that does not have a large ignition advance, since such a module is normally adjusted to an ignition position that is a compromise between starting ignition and ignition for high speed.

The maximum speed of revolutions of many hand-held tools is limited, something that is known as "excess speed protection". This both increases personal safety and increases the lifetime of the motor. Individual solutions currently exist for achieving large ignition advance, a limitation of the speed of revolutions and for preventing backfiring in motors.

SUMMARY OF THE INVENTION

The present invention concerns a circuit for achieving large ignition advance, limitation of the speed in both directions of rotation, and for preventing backfiring and reverse direction running of a motor.

The circuit on which the invention is based concerns a magnetic ignition circuit that comprises a flywheel, a three-legged iron core, and a two-poled magnetic circuit. A triggering coil is arranged either on the first, second or both of these legs of the iron core in the direction of rotation of the flywheel, while a charging coil for generating a charging pulse for a charging circuit is arranged on the final leg of the iron core. The triggering coil generates a triggering pulse to a main switch before the charging pulse, when the rotation is in the forward direction.

In order to achieve a large ignition advance, and thus safety from backfiring, the triggering coil can be wound such that each turn covers the two first legs of the three-legged iron core in the direction of rotation. In this way the triggering pulse becomes broader. The disadvantage of this is that the flux passes through both legs, which affects the shape of the induced triggering pulse, something that can disturb the normal function. Another solution is to make the mechanical extent of the first leg greater, which gives a broader triggering pulse, which in turn makes possible a larger ignition advance. The disadvantage of this is that the system becomes larger and heavier.

The invention, which is intended to solve these problems, is characterised by a time-constant circuit, in this case an RC net, which is connected between the charging circuit and the main switch. Such a net is previously known and is often used as an excess speed protection. In the invention according to the present application the time-constant circuit controls a control switch that opens/blocks triggering pulses to the main switch, whereby the net can be used for limiting the speed of revolutions, in order to achieve safety from reverse direction running and to achieve large ignition advance in a cost-efficient manner without the ignition system becoming unnecessarily large and clumsy.

Other characteristics of the invention are specified in the accompanying claims.

BRIEF DESCRIPTION OF THE DRAWINGS

In the following text, reference will be made to the attached drawings for a better understanding of the described embodiments and examples of the present invention, in which.

DETAILED DESCRIPTION OF THE INVENTION

Figure 1:
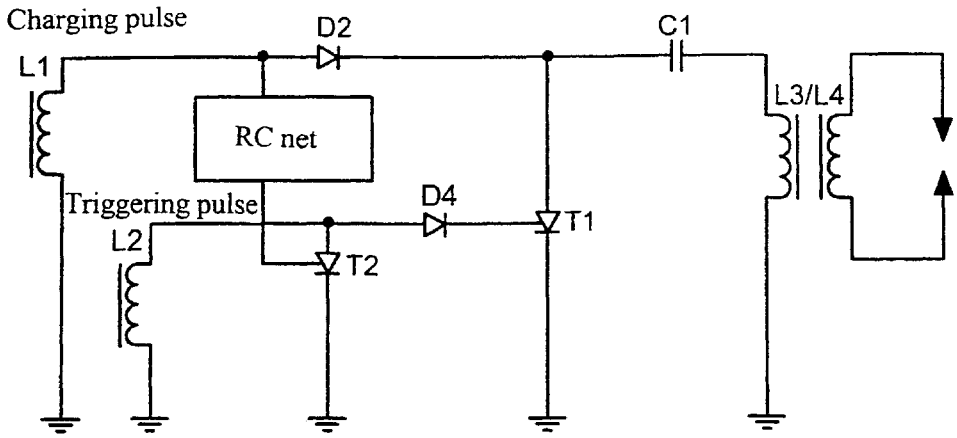
FIG. 1 shows a sketch of the principle of the circuit according to the present invention.
Figure 2:
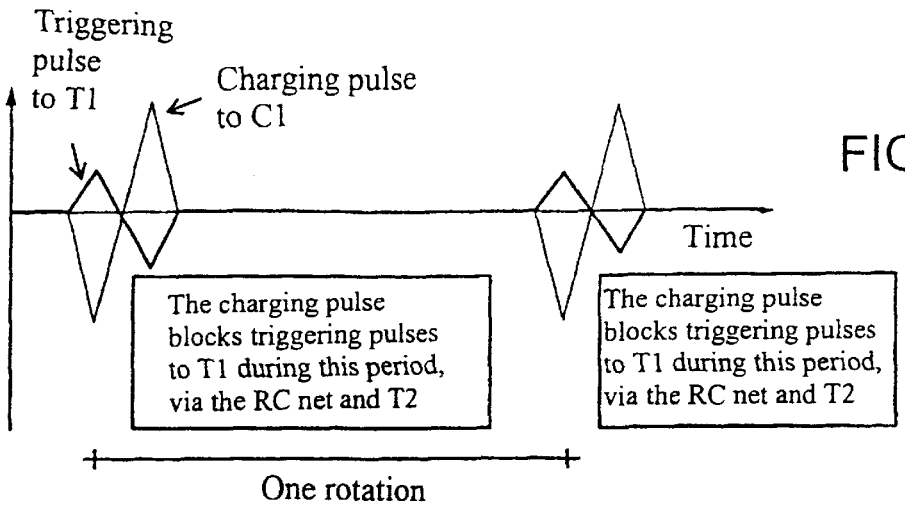
FIG. 2 shows a pulse diagram for rotation in the forward direction during normal operation.
Figure 3:
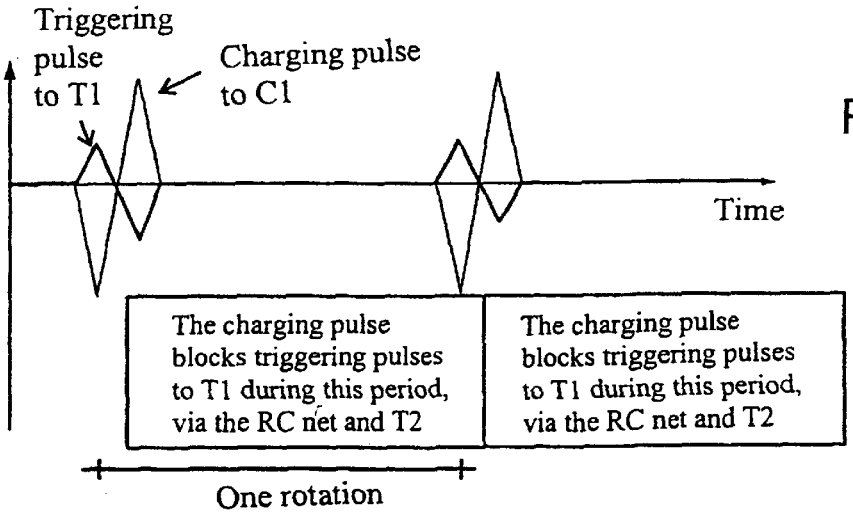
FIG. 3 shows a pulse diagram for rotation in the forward direction when the speed of revolutions is limited.
Figure 4:
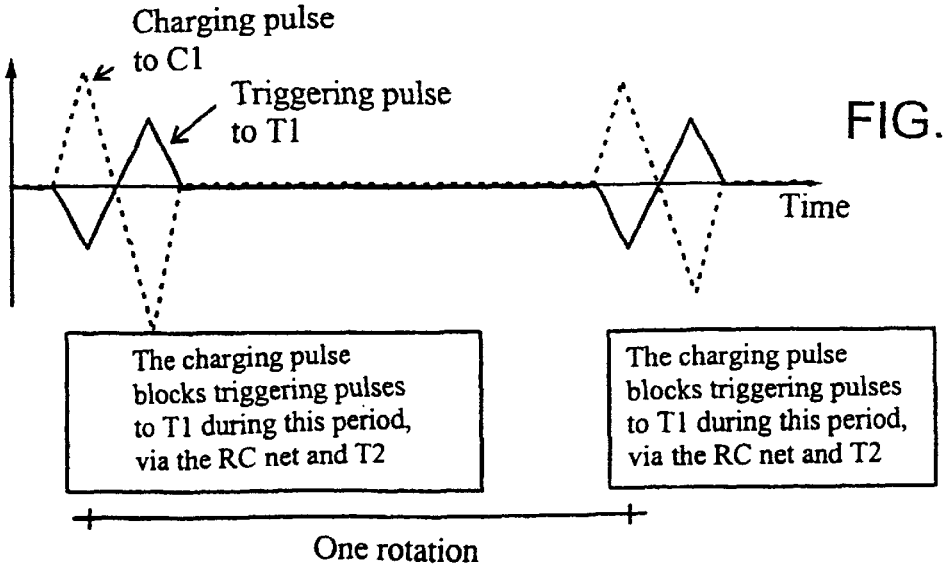
FIG. 4 shows a pulse diagram for rotation in the reverse direction.
Figure 5:
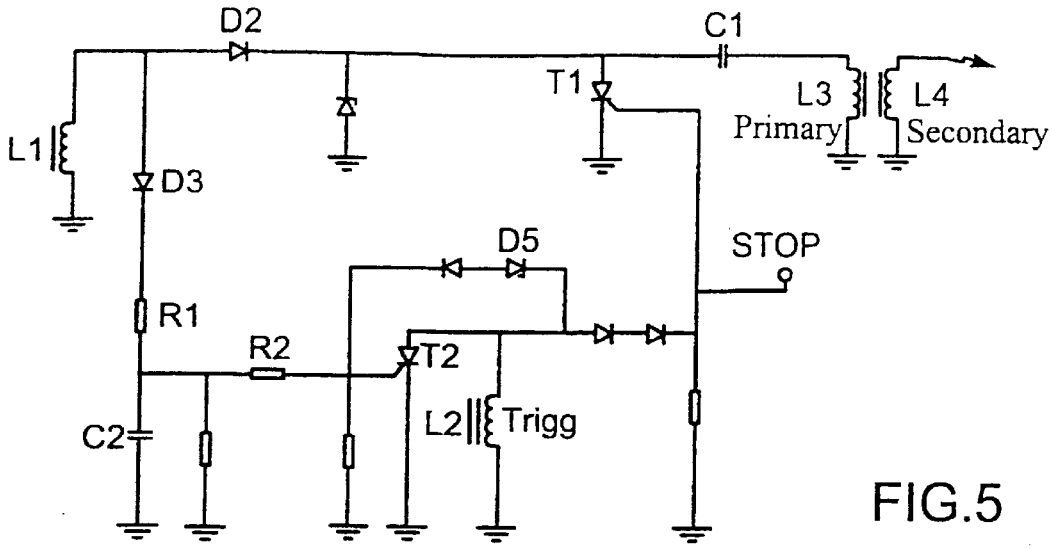
FIG. 5 shows a circuit diagram for a circuit according to the present invention, where only the components that are most important for the invention have been given reference symbols.

The circuit according to the invention to achieve a large ignition advance, limitation of the speed of revolutions in both directions of rotation and for prevention of backfiring in a magnetic ignition system comprises a flywheel and a three-legged iron core. It is preferable that the flywheel has two magnetic poles. A triggering coil L2 (see FIG. 1) for generating a triggering pulse for a main switch T1 is arranged either on the first leg or the second leg of the iron core in the direction of rotation of the flywheel and a charging coil L1 for generating a charging pulse for a charging circuit is arranged on the last leg of the iron core. The triggering pulse is located earlier in time than the charging pulse when the rotation is in the forward direction. A time-constant circuit, which in the case shown is an RC net (C2, R2), is connected between the charging circuit and the triggering circuit with a preconnected diode D3. This time-constant circuit controls a control switch, which in the case shown is a thyristor T2, which opens/blocks the triggering pulse to the main switch, which in the case shown is a thyristor T1. In order to achieve limitation of the speed of revolutions, the control switch T2 is arranged to block triggering pulses during a certain period following each charging pulse.

During rotation in the backward direction, the charging pulse is arranged to block the triggering pulses to the main switch T1 via the time-constant circuit with the control switch. The pulses then arrive close to each other in the inverse order whereby the triggering pulse to the main switch T1 is blocked.

In one preferred embodiment, the magnetic ignition system is built up from a triggering coil L2, a charging coil L1 and an ignition transformer L3/L4 placed onto a common three-legged iron core. When the flywheel rotates, a potential is induced in the charging coil L1, the charging pulse, via a diode D2 to a charging condenser C1. A potential is induced in the triggering coil L2, a triggering pulse, which is led to the control of the main switch T1, whereby this switch opens. When the main switch T1 opens, the potential is led from the charging condenser C1 to the ignition transformer L3/L4, which causes the formation of a spark on the high-tension output of the ignition transformer.

The same circuit is used to limit the speed of revolutions in both the forward and the backward directions. The charging pulse from the charging coil is connected to an RC net with a time constant that can be determined. This RC net controls the control of the control switch T2. When the control switch T2 is conducting, the triggering pulse will be led through it and thus the main switch T1 does not receive a control pulse. This means that the condenser C1 is not discharged, and thus the motor does not receive a spark. Excess speed protection is in this way achieved.

Thus the following events must take place in the specified order in order for a spark to be obtained:

1) The condenser C1 is charged by a charging pulse, and
2) The main switch T1 is opened by a triggering pulse, which ensures that the condenser C1 is discharged through the ignition transformer L3/L4.

During forward rotation, the triggering pulse is located earlier in time than the charging pulse. This means that the charging of the condenser C1 is achieved by the charging pulse from the previous revolution, that is, one revolution before the triggering. Limitation of the speed of revolutions is achieved if the triggering pulse of the next revolution arrives sufficiently closely in time to the charging pulse of the previous revolution. In this case, the time is sufficiently short for the RC net to still hold the control switch T2 open, and the triggering pulse is led through this whereby the main switch T1 does not receive a control pulse. The condenser C I will then not be discharged and a spark is not produced.

During backward rotation, the triggering pulse is located in time immediately after the charging pulse, since the pulses exchange order when the direction of rotation is changed. The control switch T2 will be opened by the charging pulse, and the triggering pulse, which is induced in the triggering coil L2 immediately after the charging pulse, is led through the control switch T2 instead of through the control electrode on the main switch T1. In this way, the main switch T1 does not receive a control pulse, the condenser C1 is not discharged and no spark is produced.

A certain function may be present at low speeds of revolutions. It is important to prevent personal injury, and thus the limitation of speed during reverse direction running must start before the centrifugal coupling that connects the motor with the saw chain is activated. Typically, this occurs at 3,000 rpm.

At high speeds of revolutions, the triggering pulse will hold the main switch T1 open simultaneously with the arrival of the charging pulse. This depends on, among other causes, the coils affecting the appearance of the pulses differently depending on the speed of revolutions of the motor. The result will be a partial overlapping of the charging pulse by the triggering pulse at high speed. The main switch T1 will remain open when the charging pulse arrives, due to the overlap, and the condenser C1 should then be charged. The charging pulse will be conducted away through the main switch T1 and thus the ignition system will cease to function. Although it is true that this results in limitation of the speed, this is difficult to control and thus unsuitable for use. This effect is instead removed so that it does not interfere with the limitation of speed described above. For this purpose, a Zener diode D5 or similar device, is connected between the control of the main switch T1 and the control electrode of the control switch T2. This means that the control switch T2 will be opened on the application of a voltage that is greater than the necessary control voltage to the main switch T1. In this case, the triggering coil L2 is short-circuited through the control switch T2 and the overlap is removed. A filter can be placed on the control electrode to the control switch T2 in order to eliminate the sensitivity to interference.

Figure 6:
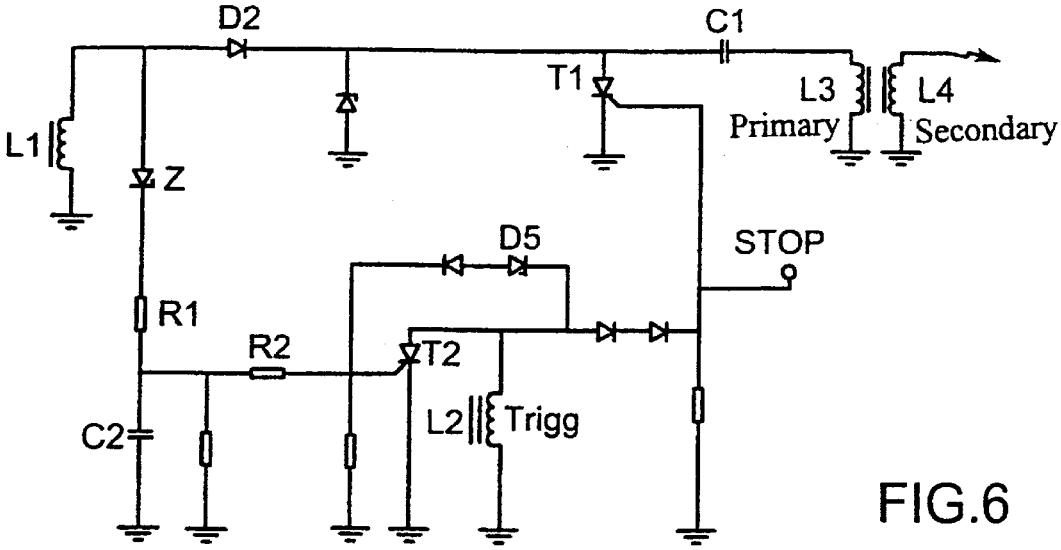
FIG. 6 shows a diagram of connections according to an alternative embodiment of the invention.

An interference pulse arises on the charging pulse at high speeds of revolutions that may lead to disengagement in the forward direction of motion. The period during which the control switch T2 is open following the charging pulse can be made to depend on the amplitude, that is, non-linear, if the diode D3 is replaced by a Zener diode Z, see FIG. 6. The potential in the condenser C2, from the interfering pulse, will be discharged when the charging pulse reaches sufficiently large negative amplitudes.

A large time constant can be used in this way without causing the activation of T2 in the forward direction at high speeds of revolutions, while causing the activation of T2 at low speeds of revolutions in the reverse direction. For rotation in the reverse direction, the condenser C2 is not discharged through the Zener diode Z until T2 has had time to short-circuit the undesired triggering pulses and thus removes them.

The function and the construction of the present invention are supposed to be made clear by the description given. Even if the embodiments of the invention that have been described have been preferred, it is evident that modifications can be made within the framework of the scope that is defined in the attached claims.

What is claimed is:

1. A circuit to achieve ignition advance, limitation of speed of revolutions and to prevent backfiring and reverse direction running in a magnetic ignition system comprising a flywheel, which magnetic ignition system comprises an ignition transformer, a triggering coil to generate a triggering pulse to a main switch and a charging coil to generate a charging pulse to a charging circuit, whereby the triggering pulse is arranged to lie before the charging pulse when the flywheel rotates in the forward direction, characterised in that the circuit comprises a control switch controlling a time-constant circuit that opens/blocks the triggering pulse that is connected between the charging circuit and the main switch, which ensures that triggering occurs on the triggering pulse of the next revolution, whereby limitation of the speed of revolutions occurs by means of adjustment of the time-constant circuit and that backfiring is prevented in that the charging pulse is arranged to block the subsequent triggering pulse via the time-constant circuit and the control switch.

2. The circuit according to claim 1, characterised in that the flywheel has two magnetic poles.

3. The circuit according to claim 1 characterised in that the triggering coil and the charging coil are arranged on a three-legged iron core.

4. The circuit according to claim characterised in that the circuit comprises a Zener diode that is connected between the control of the main switch and the control of the control switch whereby the control switch will open at a voltage that is greater than the necessary control voltage of the main switch.

5. The circuit according to claim 1, characterised in that the circuit comprises a resistor that is connected between the control of the main switch and the control of the control switch whereby the control switch will open at a voltage that is greater than the control voltage that is necessary for the main switch.

* * * * *

UNITED STATES PATENT AND TRADEMARK OFFICE

CERTIFICATE OF CORRECTION

PATENT NO. : 6,766,787 B2
DATED : July 27, 2004
INVENTOR(S) : Kihlberg et al.

It is certified that error appears in the above-identified patent and that said Letters Patent is hereby corrected as shown below:

Column 1,
Line 27, after "point" -- of -- should be inserted.

Column 3,
Lines 53 and 54, "CI" should be -- C1 --.

Column 5,
Line 10, after "claim" -- 1 -- should be inserted.

Signed and Sealed this

Second Day of August, 2005

JON W. DUDAS
*Director of the United States Patent and Trademark Office*